US006379192B1

(12) United States Patent
Wang et al.

(10) Patent No.: US 6,379,192 B1
(45) Date of Patent: Apr. 30, 2002

(54) SOLDERLESS CABLE CONNECTOR ASSEMBLY

(75) Inventors: Suiya Wang; GuangXing Shi, both of Kunsan (CN)

(73) Assignee: Hon Hai Precision Ind, Co., Ltd., Taipei Hsien (TW)

( * ) Notice: Subject to any disclaimer, the term of this patent is extended or adjusted under 35 U.S.C. 154(b) by 0 days.

(21) Appl. No.: 09/892,067

(22) Filed: Jun. 25, 2001

(30) Foreign Application Priority Data

Dec. 30, 2000 (TW) ..... 89222898 U

(51) Int. Cl.[7] ..... H01R 24/00
(52) U.S. Cl. ..... 439/676; 439/395
(58) Field of Search ..... 439/676, 344, 439/492, 495, 499

(56) References Cited

U.S. PATENT DOCUMENTS 6,250,966 B1 * 6/2001 Hashimoto et al. ..... 439/495
6,276,943 B1 * 8/2001 Boutros et al. ..... 439/676
6,280,239 B1 * 8/2001 Cheng ..... 439/495
6,336,830 B1 * 1/2002 Lee ..... 439/676

* cited by examiner

*Primary Examiner*—Hien Vu
(74) *Attorney, Agent, or Firm*—Wei Te Chung

(57) ABSTRACT

A cable connector assembly (1) comprises an electrical connector (10), a pressing device (20), and a plurality of wires (31). The electrical connector comprises an insulative housing (12), and a plurality of contacts (131) received in the housing. The insulative housing defines an opening (114) and a plurality of contact recesses (134). Each contact has a mating portion (136) for electrically connecting with a mating connector, and a tail portion (137) received in a corresponding contact recess. Each wire has a conductor core (32) for electrically connecting with the contact (131). The pressing device (20) is assembled to the opening (114) and comprises a base section (21) and a plurality of resilient elements (22) secured to the base section. Each resilient element is received in the corresponding contact recess to press the conductor core against the tail portion of a corresponding contact.

4 Claims, 7 Drawing Sheets

SOLDERLESS CABLE CONNECTOR ASSEMBLY

BACKGROUND OF THE INVENTION

1. Field of the Invention

The present invention relates to a cable connector assembly, and particularly to a solderless cable connector assembly which employs a pressing device to connect a cable with an electrical connector.

2. Description of the Related Art

A cable connector assembly is commonly used in computer systems and communication networks. The cable connector assembly comprises an electrical connector and a cable connected thereto. The cable has a plurality of wires for electrically connecting with corresponding contacts of the electrical connector. There exist several conventional connection ways between the contacts and the wires. Generally, each contact has an insulation displacement portion to terminate each corresponding wire as disclosed in U.S. Pat. Nos. 5,624,274, 5,087,210, and 5,885,111. However, each wire should be accurately positioned corresponding to each contact to ensure an electrical engagement therebetween. Moreover, during the piercing procedure, an unstable piercing force may cause an unreliable engagement between the contacts and the communication wires. The cable connector assembly may also adopt a circuit board for connection of the wires to the contacts as disclosed in U.S. Pat. No. 6,053,770. The contacts are soldered to contact pads on a first side of the circuit board; conductor cores of the wires are soldered to contact pads on a second side of the circuit board. However, connecting the contacts and the wires to the circuit board is time-consuming and thus increases the cost of production.

Hence, an improved cable connector assembly is desired to overcome the disadvantages of the related art.

SUMMARY OF THE INVENTION

An object of the present invention is to provide a solderless cable connector assembly having a pressing device which can make a cable easily and accurately connected to corresponding contacts of an electrical connector, thereby ensuring a reliable electrical engagement between the electrical connector and the cable.

To achieve the above-mentioned object, a cable connector assembly in accordance with the present invention comprises an electrical connector, a cable consisting of a plurality of wires, and a pressing device for connecting the cable to the electrical connector. The electrical connector comprises an insulative housing and a plurality of contacts received in the housing. The insulative housing defines an opening and a plurality of contact recesses. Each contact has a mating portion for electrically engaging with a mating connector, and a tail portion received in a corresponding contact recess of the housing. The wires each have a conductor core and an outer insulation layer. The conductor core has a portion that is exposed for electrically connecting with a corresponding contact. The pressing device comprises a base section defining a depression at a bottom thereof, and a plurality of resilient elements secured to the base section. Each resilient element has a securing portion embedded in the base of the pressing device, an intermediate portion extending from the securing portion, and a contact portion extending from the securing portion into the depression for contacting with the exposed portion of the conductor core.

When the pressing device is assembled to the opening of the housing, each resilient element is received in a corresponding contact recess to press the exposed portion of the conductor core against the tail portion of a corresponding contact. Thus, an electrical engagement is established between the cable and the electrical connector.

Other objects, advantages and novel features of the invention will become more apparent from the following detailed description of the present embodiment when taken in conjunction with the accompanying drawings.

DETAILED DESCRIPTION OF THE INVENTION

Figure 1:
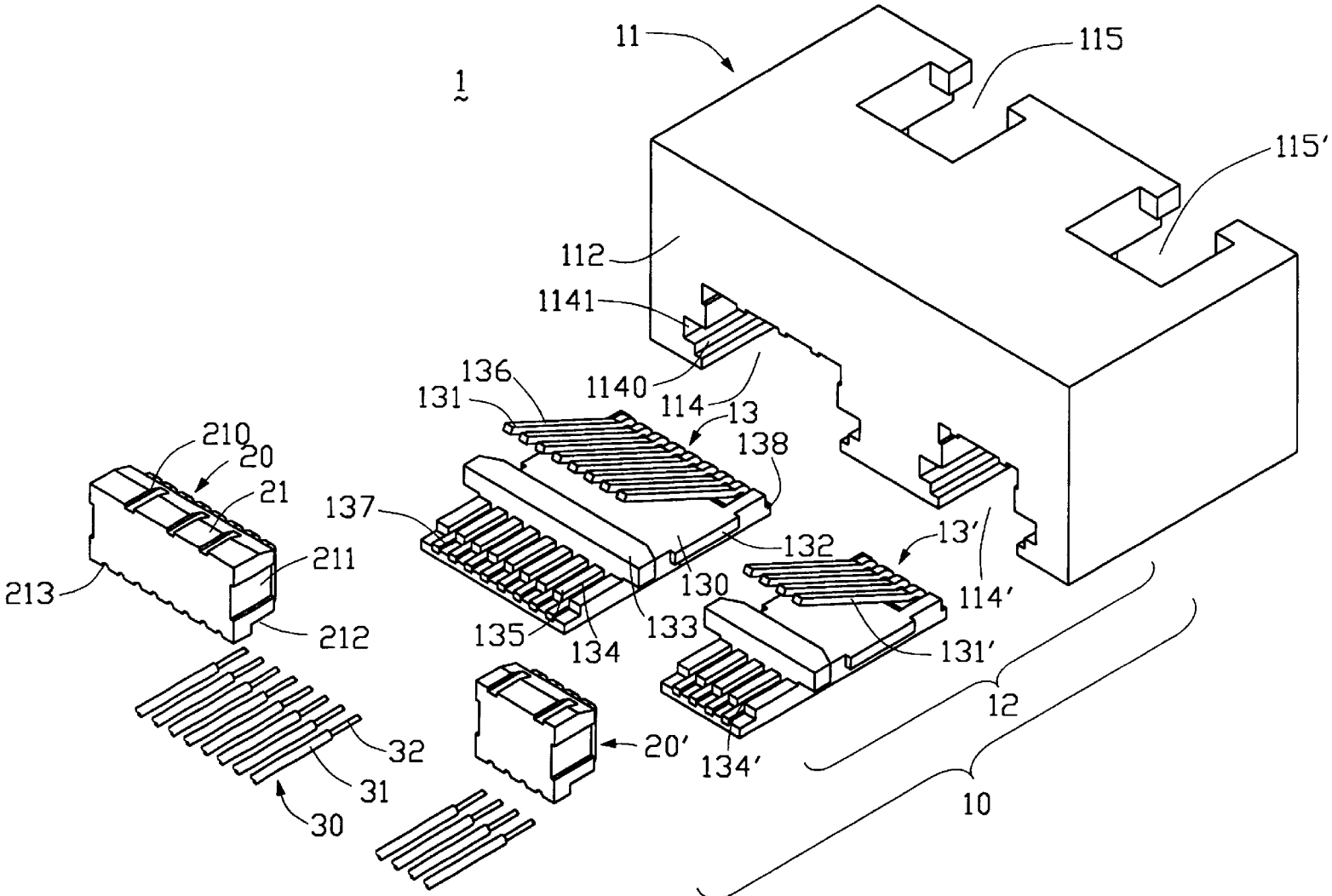
FIG. 1 is an exploded perspective view of a cable connector assembly in accordance with the present invention.

Referring to FIG. 1, a cable connector assembly 1 in accordance with the present invention comprises an electrical connector 10, a cable 30, and a first pressing device 20 and a second pressing device 20' for connecting the cable 30 to the electrical connector 10.

The electrical connector 10 in a preferred embodiment of the present invention is a receptacle connector assembly which consists of an RJ45 receptacle modular jack and an RJ11 receptacle modular jack. The electrical connector 10 comprises an insulative housing 12, and a plurality of first and second contacts 131, 131' received in the insulative housing 12.

The insulative housing 12 comprises a base 11 of a rectangular configuration, and a first and second insulative modules 130 separative or integral with the base 11. In the preferred embodiment of the present invention, the first insulative module 130 and the second insulative module 130' are both separative with the base 11.

Figure 4:
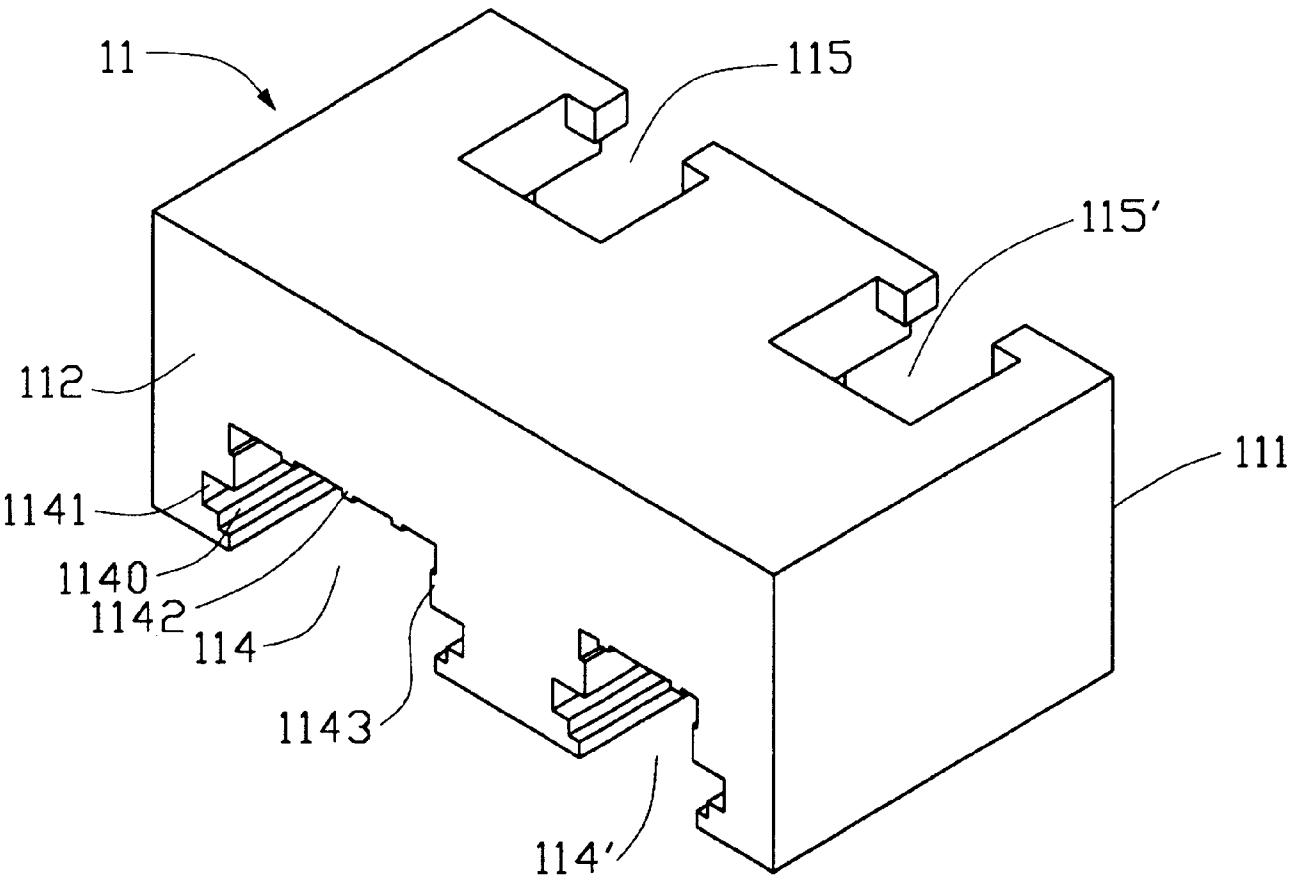
FIG. 4 is a perspective view of an insulative housing shown in FIG. 1.
Figure 5:
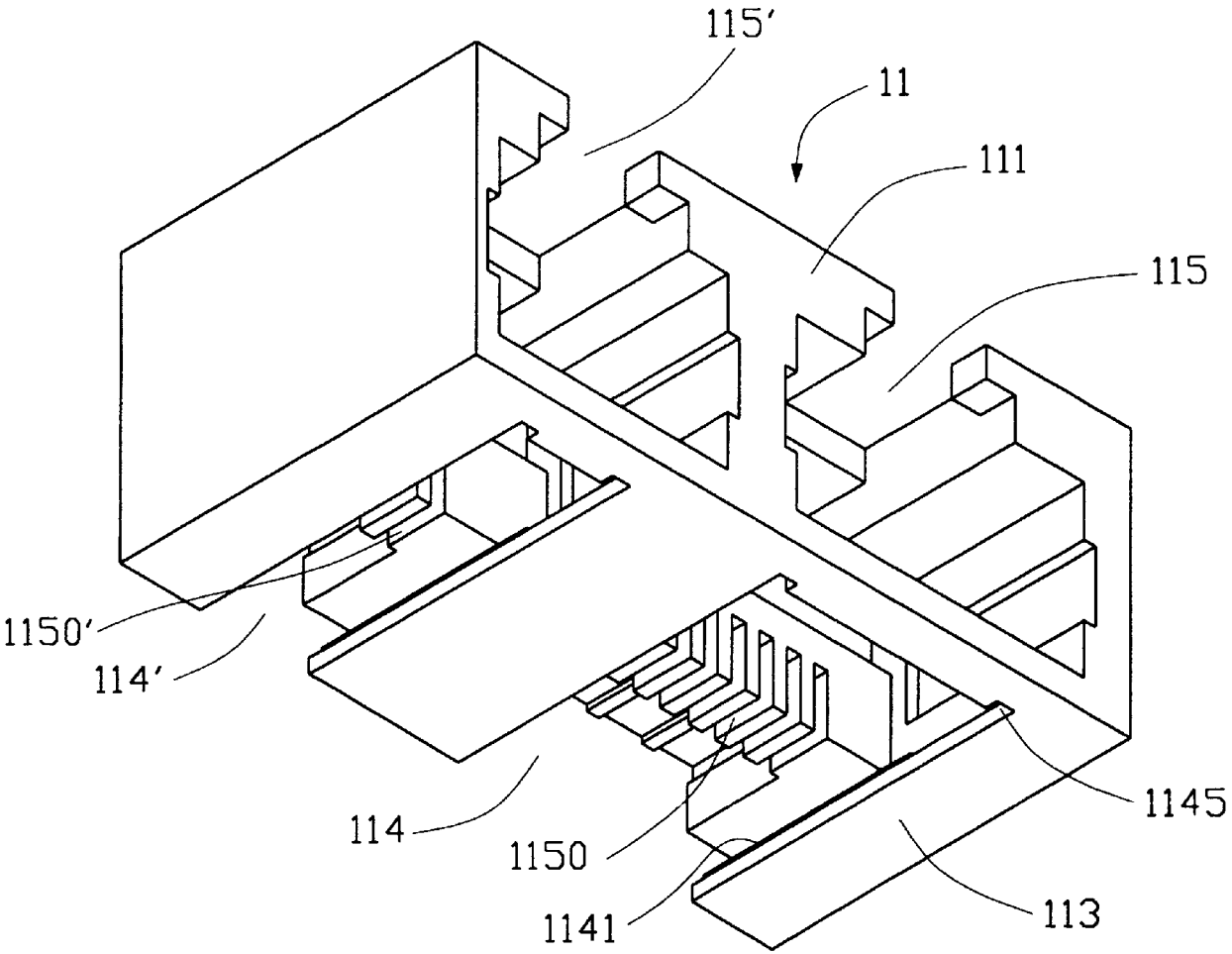
FIG. 5 is a view similar to FIG. 4 but taken from a different perspective.

Further referring to FIGS. 4 and 5, the base 11 has a front surface 111, a rear surface 112, and a bottom surface 113 communicating with the front surface 111 and the rear surface 112. The base 11 further defines a first receiving cavity 115 extending from the front surface 111 thereof for receiving a mating RJ45 plug connector (not shown), and a second receiving cavity 115' adjacent to the first receiving cavity 115 for receiving a mating RJ11 plug connector (not shown). The base 11 defines a first opening 114 extending from the rear surface 112 and through the bottom surface 113 to join the first receiving cavity 115, and a second opening 114' adjacent to the first opening 114 and joining the second receiving cavity 115'. The base 11 still defines a plurality of first passageways 1150 in the first receiving cavity 115, and a plurality of second passageways 1150' in the second receiving cavity 115'. The base 11 has a pair of guiding recesses 1140, a pair of channels 1141, and a pair of bosses 1143 on two opposite sides of the first opening 114, a plurality of projections 1142 extending downwardly from a top surface of the first opening 114, and a pair of cutouts 1145 (FIG. 5) on the bottom surface 113 and adjacent to the front surface 111. The second opening 114' has a configuration substantially the same as that of the first opening 114, except a smaller size of the second opening 114'.

The first contacts 131 are secured to the first insulative module 130 to form a first contacts module 13. The second contacts 131' are secured to the second insulative module 130' to form a second contacts module 13'. The first insulative module 130 has a pair of guiding portions 132 on two opposite sides thereof, and a crossbeam 133 protruding from a top surface and having two free ends that projects outwards beyond the two opposite sides thereof. The first insulative module 130 defines a plurality of contact recesses 134 on a rear portion thereof, a plurality of bosses 135 each extending upwardly between two neighboring contact recesses 134, and a pair of projections 138 protruding from a front portion thereof. The first contacts 131 each comprises a mating portion 136 extending above the top surface of the first insulative module 130 for electrically engaging with the mating connector, a fixing portion 139 (FIG. 7) extending from the mating portion 136 and embedded in the first insulative module 130, and a tail portion 137 extending from the fixing portion 139 and received in a corresponding contact recess 134 of the first insulative module 130. The second contacts module 13' has a configuration substantially the same as that of the first contacts module 13, except a smaller size of the second contacts module 13' and a fewer number of second contact recesses 134'.

The cable 30 comprises a plurality of wires 31 each having a conductor core 32 which is surrounded by an outer insulation layer. The conductor core 32 has a portion exposed out of the outer insulation layer for electrically connecting with the tail portion 137 of a corresponding contact (131).

Figure 2:
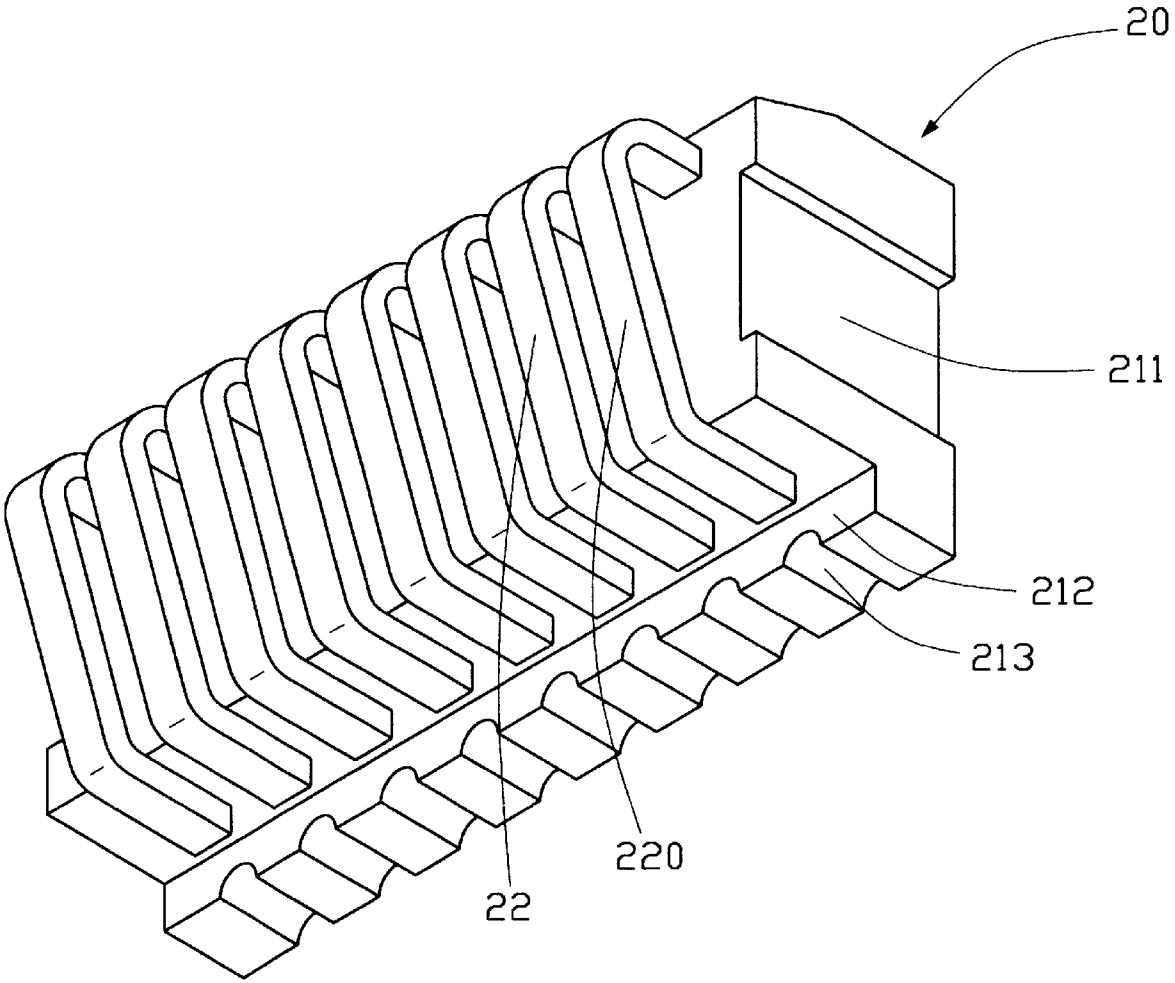
FIG. 2 is a perspective view of a pressing device of the cable connector assembly.
Figure 3:
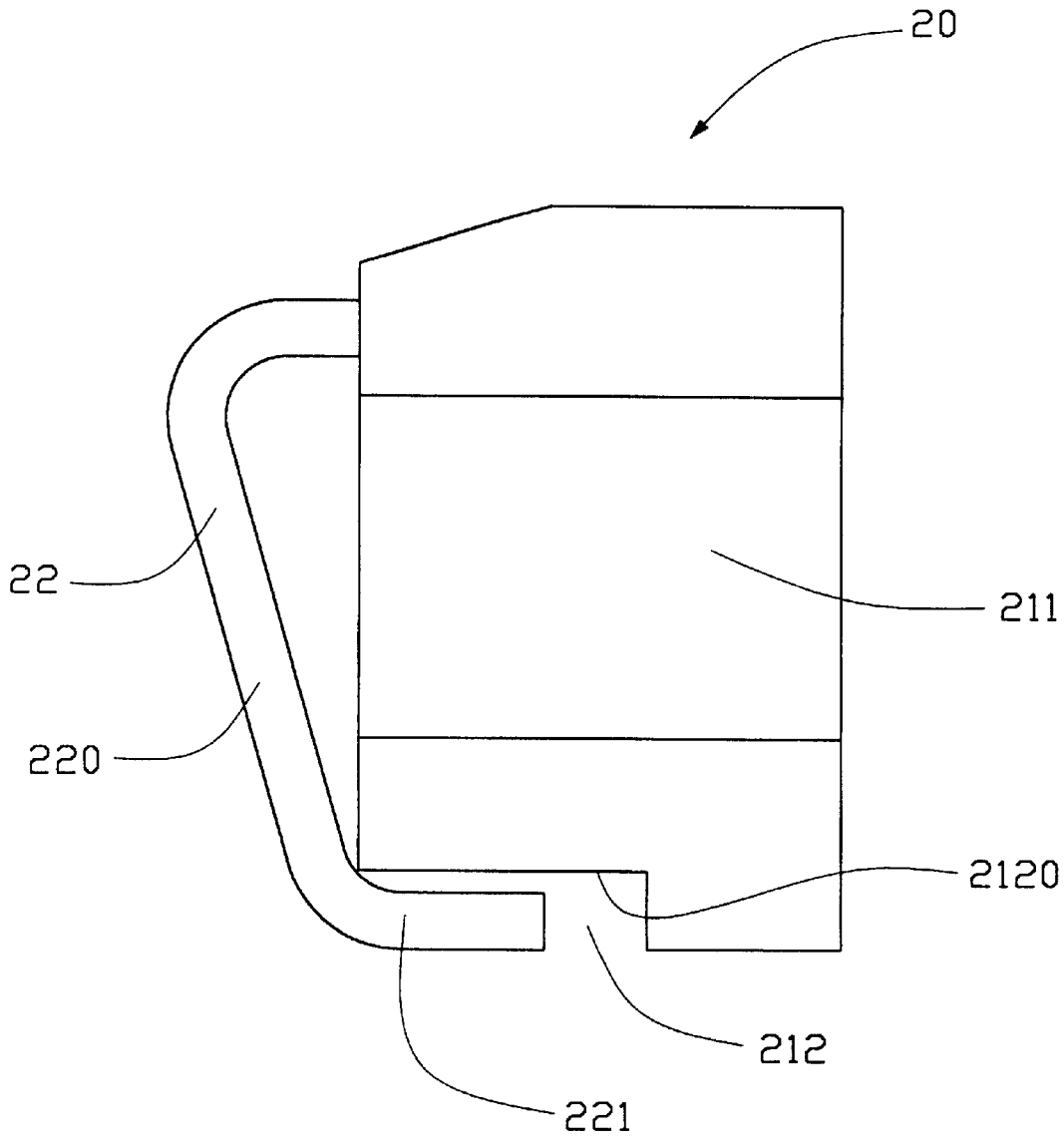
FIG. 3 is a side plan view of the pressing device shown in FIG. 2.

Also referring to FIGS. 2 and 3, the first pressing device 20 includes a base section 21 of a rectangular configuration, and a plurality of resilient elements 22 secured to the base section 21. The base section 21 defines a plurality of cutouts 210 on a top surface thereof, a pair of recesses 211 on two opposite sides thereof, a depression 212 at a bottom thereof, and a plurality of grooves 213 adjacent to the depression 212 for receiving and retaining the wires 31. In the preferred embodiment of the present invention, the resilient elements are a plurality of resilient contacts 22. Each resilient contact 22 has a securing portion 222 (FIG. 7) embedded in the base section 21, an intermediate portion 220 extending from the securing portion 222, and a contact portion 221 extending from the intermediate portion 220 into the depression 212. There exists a clearance between the contact portion 221 of the resilient contact 22 and a top surface 2120 (FIG. 3) of the depression 212. The second pressing device 20' has a configuration substantially the same as that of the first pressing device 20, except a smaller size of the second pressing device 20'.

Figure 6:
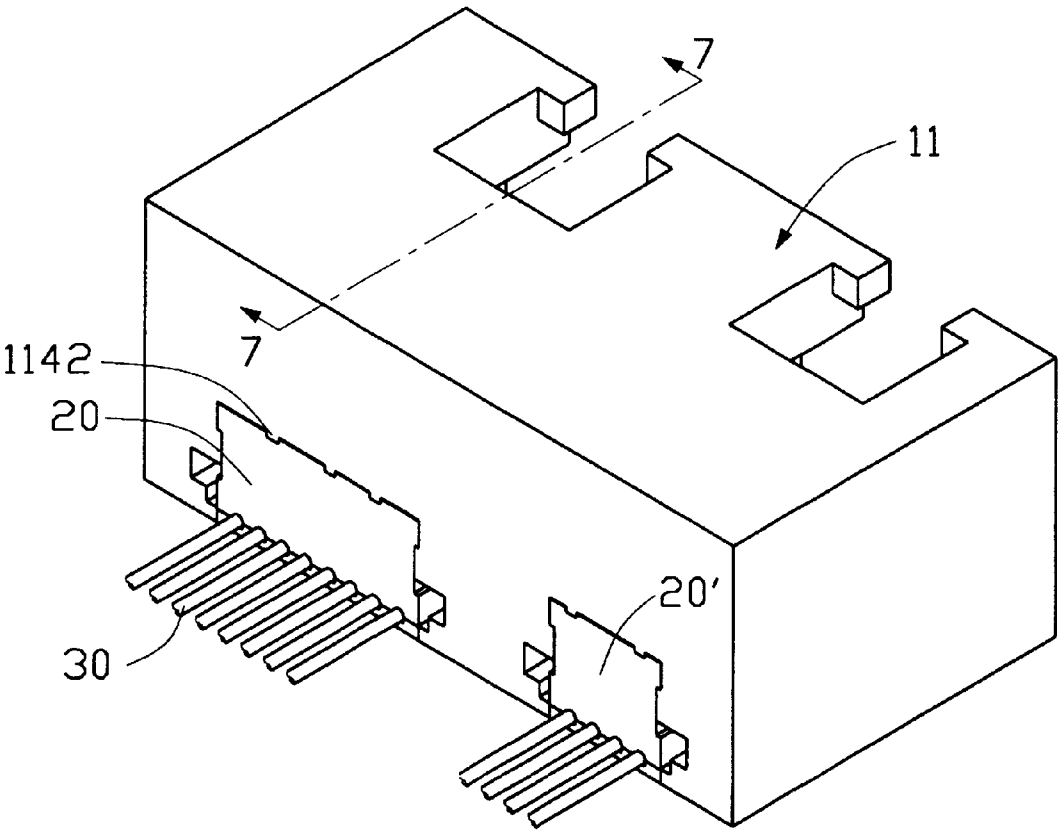
FIG. 6 is an assembled perspective view of FIG. 1.
Figure 7:
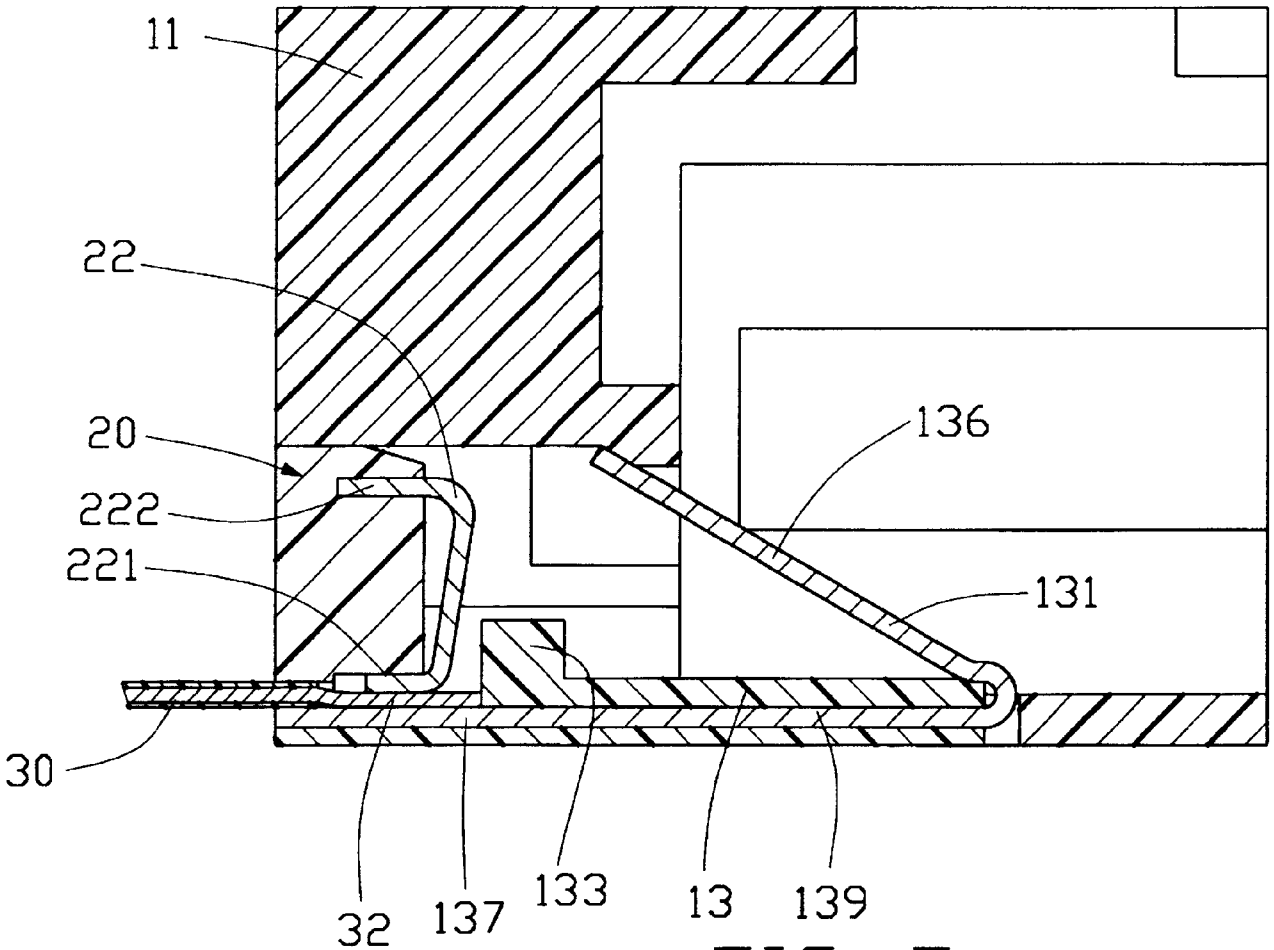
FIG. 7 is a cross-sectional view of the cable connector assembly taken along section line 7—7 in FIG. 6.

Further referring to FIGS. 6–7, in assembly, the first contacts module 13 is assembled to the lower position of the first opening 114 from the rear surface 112 of the base 11, the guiding portions 132 are received in the guiding recesses 1140 and the free ends of the crossbeam 133 are received in the channels 1141 to facilitate sliding the first contacts module 13 into the first opening 114 until the projections 138 of the contacts module 13 are received and retained in the cutouts 1145 of the base 11. Also, the mating portions 136 of the first contacts 131 extend into the first receiving cavity 115 of the base 11 for electrically engaging with the mating connector. At the same time, a free end of each mating portion 136 is received and retained in a corresponding first passageway 1150.

Then, the wires 31 is inserted into the first opening 114 from the rear surface 112 of the base 11 until the exposed portions of the conductor cores 32 are received in the contact recesses 134 of the first contacts module 13, respectively.

Finally, the first pressing device 20 is assembled to the upper position of the first opening 114, the projections 1142 on a top surface of the first opening 114 are received in the cutouts 210 of the first pressing device 20, and the bosses 1143 on two opposite sides of the first opening 114 are received in the recesses 211 of the first pressing device 20. The bottom of the base section 21 abuts against the bosses 135 of the first contacts module 13. The contact portions 221 of the resilient contacts 22 slide into corresponding contact recesses 134 of the first contacts module 13 to press the exposed portions of the conductor cores 32 against tail portions 137 of the first contacts 131, respectively. Thus, an electrical engagement is established between the conductor cores 32 and the first contacts 131. During the assembly, the contact recesses 134 of the first contacts module 13 also serve as guiding recesses to actuate the contact portions 221 of the resilient contacts 22 to be easily and accurately received in the contact recesses 134, thereby ensuring a reliable electrical engagement between the electrical connector 10 wires 31. Moreover, the wires 31 and the first contacts 131 are not damaged, so the cable connector assembly 1 can be disassembled and reused thus reducing the cost of production.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principle of the invention to the full extent indicated by the broad general meaning of the terms in which the appended claims are expressed.

What is claimed is:

1. A cable connector assembly comprising:

an electrical connector comprising an insulative housing and a module having a plurality of contacts received in the insulative housing, the insulative housing defining an opening and a plurality of contact recesses, each contact having a mating portion for electrically engaging with a mating connector and a tail portion received in a corresponding contact recess of the housing;

a plurality of wires each having a conductor core and an outer insulation layer, a portion of the conductor core being exposed for electrically connecting with a corresponding contact; and a pressing device assembled to the opening of the housing and comprising a base section and a plurality of resilient elements secured to the base section, each resilient element being received in the corresponding contact recess to press the exposed portion of the conductor core against the tail portion of a corresponding contact;

wherein the base section defines a depression at a bottom thereof, and a plurality of grooves adjacent to the depression for retaining the wires;

wherein each resilient element has a securing portion embedded in the base section of the pressing device, an intermediate portion extending from the securing portion, and a contact portion extending from the intermediate portion into the depression to press the exposed portion of the conductor core against the tail portion of the contact.

2. The cable connector assembly as claimed in claim 1, wherein a clearance exists between the contact portion and a top surface of the depression before the pressing device is assembled to the opening of the insulative housing.

3. The cable connector assembly as claimed in claim 1, wherein the insulative housing comprises an insulative module securing the contacts to form a contacts module, the contact recesses being located at a rear portion of the contacts module.

4. The cable connector assembly as claimed in claim 3, wherein the contacts module is assembled to the lower position of the opening, a rear portion of the contacts module being adjacent to a rear surface of the housing.

* * * * *